US006352414B1

(12) United States Patent
Popov

(10) Patent No.: US 6,352,414 B1
(45) Date of Patent: Mar. 5, 2002

(54) OPERATION METHOD FOR A PUMPING-EJECTION APPARATUS AND MULTIPLE-STAGE PUMPING-EJECTION APPARATUS FOR REALIZING THE SAME

(75) Inventor: Serguei A. Popov, 4615 Post Oak Pl., Suite 255, Houston, TX (US) 77027

(73) Assignees: Evgueni D. Petroukhine, Limassol (CY); Serguei A. Popov, Budapest (HU)

( * ) Notice: Subject to any disclaimer, the term of this patent is extended or adjusted under 35 U.S.C. 154(b) by 0 days.

(21) Appl. No.: 09/486,910

(22) PCT Filed: Jun. 30, 1999

(86) PCT No.: PCT/IB99/01220

§ 371 Date: Mar. 3, 2000

§ 102(e) Date: Mar. 3, 2000

(87) PCT Pub. No.: WO00/01952

PCT Pub. Date: Jan. 13, 2000

(30) Foreign Application Priority Data

Jul. 3, 1998 (RU) ..... 98113117

(51) Int. Cl.[7] ..... F04F 5/22; B01D 19/00
(52) U.S. Cl. ..... 417/169; 95/176; 95/177
(58) Field of Search ..... 417/169, 174, 417/176, 77, 79; 95/176, 177; 96/194

(56) References Cited

U.S. PATENT DOCUMENTS

| | | | | |
|---|---|---|---|---|
| 3,796,640 A | * | 3/1974 | Boomer | 203/11 |
| 6,106,243 A | * | 8/2000 | Popov | 417/313 |
| 6,120,254 A | * | 9/2000 | Popov | 417/151 |

FOREIGN PATENT DOCUMENTS

| | | | |
|---|---|---|---|
| DE | 1092044 | | 11/1960 |
| RU | 2073123 | * | 2/1997 |
| RU | 2094070 | | 10/1997 |
| SU | 1955 | | 11/1926 |
| WO | WO 96/05900 | | 2/1996 |
| WO | WO 96/16711 | * | 6/1996 |

* cited by examiner

*Primary Examiner*—Charles G. Freay
*Assistant Examiner*—Michael K. Gray
(74) *Attorney, Agent, or Firm*—Mark A. Oathout

(57) ABSTRACT

The invention pertains to the field of jet technology and relates to an operating process of a multiple-stage pump-ejector-separator system which essentially includes bypassing a motive liquid from a second-stage separator into a first-stage one and subsequent delivery of the motive liquid from the first-stage separator to the suction port of a pump. The invention also relates to a device for realizing the process which essentially constitutes a multiple-stage pump-ejector-separator system, wherein the suction side of a pump is connected to a first-stage separator, the first-stage and second-stage separators are interconnected by a vertical U-tube acting as a hydro seal, where the height of the U-tube above the motive liquid level in the second-stage separator is not less than the height of the liquid column created in the U-tube by the motive liquid from the second-stage separator under a pressure difference between the two separators. There is another variant of the system where the second-stage separator is equipped with a level gage, the suction side of the pump is connected to the first-stage separator, the first-stage and second-stage separators are interconnected by a pipe, and the pipe is furnished with a flow regulator connected to the level gage. The described operating process and related multiple-stage pump-ejector-separator system provides a higher reliability and a higher capacity.

7 Claims, 1 Drawing Sheet

OPERATION METHOD FOR A PUMPING-EJECTION APPARATUS AND MULTIPLE-STAGE PUMPING-EJECTION APPARATUS FOR REALIZING THE SAME

This application claims priority of International Application PCT/IB99/01220 filed Jun. 30, 1999 with priority of RU 98113117 filed Jul. 3, 1998.

BACKGROUND

The invention pertains to the field of jet technology, primarily to pump-ejector units for evacuation and compression of various gaseous mediums.

An operating process of a pump-ejector system is known, which consists in the delivery of a liquid medium into nozzles of first-stage and second-stage liquid-gas ejectors by a pump, evacuation of a gaseous medium by the first-stage ejector, discharge of a gas-liquid mixture containing the evacuated gaseous medium from the first-stage ejector into a first-stage gravity-inertial separator, evacuation of a gaseous medium from the first-stage separator by the second-stage ejector and discharge of a gas-liquid mixture from the second-stage ejector into a second-stage separator (see patent, RU, 2094070, 27.10.97).

The same patent also introduces a multiple-stage pump-ejector system having a first-stage liquid-gas ejector, a second-stage liquid-gas ejector, a first-stage gravity-inertial separator, a second-stage separator and a pump intended for delivery of a liquid medium from the second-stage separator into nozzles of the first-stage and second-stage ejectors.

The described operational process and the system for its embodiment provide evacuation of a gaseous medium from a vacuum rectification column and consequently a vacuum in the column. However such process and system do not allow sequential compression of the evacuated gas stage by stage. Therefore the application ranges of the process and the system are limited.

The closest analogue of the operational process introduced by the present invention is an operational process of a pump-ejector unit, which includes delivery of a motive liquid into nozzles of first-stage and second-stage liquid-gas ejectors by a pump, evacuating a gaseous medium by the first-stage ejector, compressing the gaseous medium in the first-stage ejector, discharging a gas-liquid mixture containing the evacuated gaseous medium from the first-stage ejector into a first-stage separator, separating the mixture in the first-stage separator into compressed gas and motive liquid, evacuating the compressed gas from the first-stage separator by the second-stage ejector, additionally compressing the evacuated compressed gas in the second-stage ejector, discharging a gas-liquid mixture containing the additionally compressed gas from the second-stage ejector into a second-stage separator, separation of the mixture in the second-stage separator into the additionally compressed gas and the motive liquid and subsequent delivery of the additionally compressed gas from the separator to consumers, and bypassing the motive liquid from the first-stage separators into the second-stage one (see application WO 96/16711, published on Jun. 6, 1996).

The same application describes a pump ejector unit having a first-stage ejector and a first-stage separator, a second-stage ejector and a second-stage separator, and a pump. A discharge side of the pump is connected to the nozzles of the first-stage and second-stage ejectors, the gas inlet of the first-stage ejector is connected to a source of an evacuated gaseous medium, an outlet of the first-stage ejector is connected to the first-stage separator, the gas inlet of the second stage ejector is connected to the gas outlet of the first-stage separator, an outlet of the second-stage ejector is connected to the second-stage separator, and the two separators are interconnected by a pipe.

With this operating process and related pump-ejector unit it is possible to evacuate a gaseous medium from a reservoir, for example from a rectification column. But the introduced layout and design of the system propose feeding a motive liquid from the first-stage separator into the second-stage one and only then delivery of the liquid from the second-stage separator into the ejectors by the pump. As a result, motive liquid with a high content of dissolved gases is fed into the ejectors nozzles. This negatively affects capacity of the ejectors, especially performance of the first-stage ejector intended for maintaining the required pressure in the evacuated reservoir.

SUMMARY OF THE INVENTION

This invention is aimed at increasing capacity of a pump-ejector system and at improving operational reliability of the system.

With regard to the operating process as the subject-matter of the invention, the stated technical problem is solved as follows: an operating process of a pump-ejector system, which includes delivery of a liquid medium into the nozzles of first-stage and second-stage liquid-gas ejectors by a pump, evacuating a gaseous medium by the first-stage ejector, compressing the gaseous medium in the first-stage ejector, discharging a gas-liquid mixture containing the evacuated gaseous medium from the first-stage ejector into a first-stage separator, separating the mixture in the first-stage separator into compressed gas and motive liquid, evacuating the compressed gas from the first-stage separator by the second-stage ejector, additionally compressing the evacuated compressed gas in the second-stage ejector, discharging a gas-liquid mixture containing the additionally compressed gas from the second-stage ejector into a second-stage separator, separating the mixture in the second-stage separator into the additionally compressed gas and the motive liquid and subsequent delivery of the additionally compressed gas from the second-stage separator to consumers, where bypassing the motive liquid between the first-stage and second-stage separators is modified so that the motive liquid passes from the second-stage separator into the first-stage separator wherefrom the motive liquid is fed into the nozzles of the first-stage and second-stage ejectors by the pump.

The bypassing of the motive liquid from the second-stage separator into the first-stage one is forced by a difference between pressures in the second-stage and first-stage separators, and the volume of the bypassed motive liquid is adjusted by an artificially created hydraulic resistance. The motive liquid is cooled prior to its delivery to the suction port of the pump.

With regard to the apparatus as the subject-matter of the invention, the mentioned technical problem is solved as follows:

A multiple-stage pump-ejector system, which has a first-stage ejector, a first-stage separator, a second-stage ejector, a second-stage separator and a pump, and wherein the discharge side of the pump is connected to the nozzles of the first-stage and second-stage ejectors, the gas inlet of the first-stage ejector is connected to a source of an evacuated gaseous medium, an outlet of the first-stage ejector is connected to the first-stage separator, the gas inlet of the second-stage ejector is connected to the gas outlet of the first-stage separator, an outlet of the second-stage ejector is connected to the second-stage separator and the two separators are interconnected by a pipe, and further has the following design features: the suction side of the pump is connected to the first-stage separator, the first-stage and second-stage separators are interconnected by a vertical U-tube acting as a hydro seal, where the height of the U-tube above the motive liquid level in the second-stage separator is not less than the height of liquid column created in the U-tube by the motive liquid from the second-stage separator under a pressure difference between the separators.

In addition, the pump-ejector system can be furnished with a third stage. In this case the gas inlet of a third-stage ejector is connected to the second-stage separator, a nozzle of the third-stage ejector is connected to the discharge side of the pump, an outlet of the third-stage ejector is connected to a third-stage separator, the third-stage separator is connected to the first-stage separator through a vertical U-tube.

There is another variant of the multiple-stage pump-ejector system having a first-stage ejector, a first-stage separator, a second-stage ejector, a second-stage separator and a pump, wherein the discharge side of the pump is connected to the nozzles of the first-stage and second-stage ejectors, the gas inlet of the first-stage ejector is connected to a source of an evacuated gaseous medium, an outlet of the first-stage ejector is connected to the first-stage separator, the gas inlet of the second-stage ejector is connected to the gas outlet of the first-stage separator, an outlet of the second-stage ejector is connected to the second-stage separator and the two separators are interconnected by a pipe. In this variant of an embodiment of the invention, the second-stage separator is furnished with a level gage, the suction side of the pump is connected to the first-stage separator, the first-stage and second-stage separators are interconnected by a pipe, which is furnished with a regulator of the motive liquid flow, and the regulator is connected to the level gage.

In this variant the system can also be furnished with a third stage. In this case the gas inlet of a third-stage ejector is connected to the second-stage separator, a nozzle of the third-stage ejector is connected to the discharge side of the pump, an outlet of the third-stage ejector is connected to a third-stage separator, and the third-stage separator is connected to the first-stage separator through a pipe with a flow regulator. The flow regulator is connected to a level gage of the third-stage separator.

Experiments have shown, that the mode of the motive liquid circulation and the regime of feeding the motive liquid from one separator to another exert a significant influence on the capacity of the multiple-stage pump-ejector system. The regime of the motive liquid feeding from one separator to another also affects the operational reliability of the system. Therefore bypassing of the motive liquid from one separator to another with minimal hydraulic losses and minimal usage of additional equipment with moving parts contributes to a higher reliability and a higher capacity of the system. The difference in pressures in the separators allows bypassing of the motive liquid from the second-stage and third-stage separators to the first-stage separator by gravity, i.e. without usage of any pumping equipment. The availability of the vertical U-tubes between the separators prevents the inrush of gases from the second-stage and third-stage separators into the first-stage separator because these U-tubes simultaneously act as hydro seals between the separators.

It was found, that the content of dissolved gases in the motive liquid significantly affects the capacity of the pump-ejector system. The lower the content of dissolved gases in the motive liquid, the deeper the vacuum which can be obtained at the gas inlet of a liquid-gas ejector while required power input remains the same. Bypassing of the motive liquid from the second-stage and third-stage separators into the first-stage separator and subsequent delivery of the motive liquid from the first-stage separator to the suction port of the pump provides a supply of the motive liquid both into the first-stage and second-stage ejectors from a reservoir (namely from the first-stage separator) wherein pressure is minimal. As a rule, pressure in the first-stage separator is lower than atmospheric. This allows more intensive degassing of the motive liquid. So, the motive liquid with a minimal content of dissolved gases can be fed into the ejectors nozzles. Another embodiment of the multiple-stage system proposes to deliver the motive liquid from the second-stage and third-stage separators into the first-stage separator through the tubes, which are equipped with flow regulators (valve devices for example). Throughput of these regulators depends on the motive liquid level in the second-stage and third-stage separators because the regulators are connected to the level gages of the separators. Subject to the motive liquid level, the level gages transmit appropriate signals to the regulators, so that the regulators open their flow areas when the motive liquid levels in the separators rise.

Thus, the introduced operational process and related multiple-stage system provide a solution to the stated technical problem, i.e. the described multiplestage system implementing the introduced process exhibits an increased reliability and capacity.

DETAILED DESCRIPTION

Figure 1:
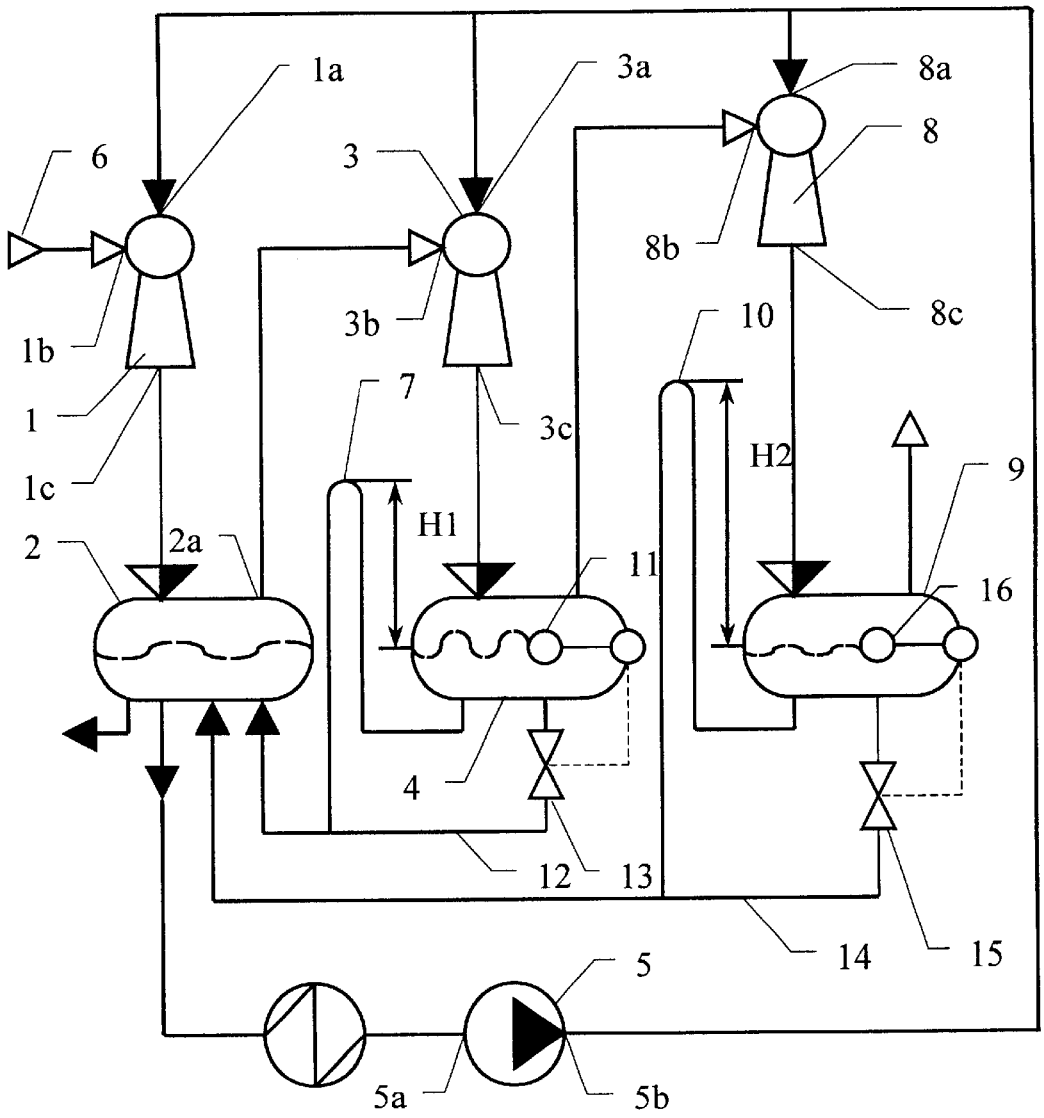
FIG. 1 represents a schematic diagram of the pump-ejector-separator system implementing the introduced operational process. The system has devices for realization of the both proposed variants of motive liquid bypassing.

The multiple-stage pump-ejector-separator system has a first-stage liquid-gas ejector 1 and a first-stage separator 2, a second-stage ejector 3 and a second-stage separator 4, and a pump 5. The discharge side 5*b* of the pump 5 is connected to the liquid inlets 1*a* and 3*a* of the ejectors 1 and 3 respectively, the gas inlet 1*b* of the first-stage liquid-gas ejector 1 is connected to a source 6 of an evacuated gaseous medium, an outlet 1*c* of the ejector 1 is connected to the first-stage separator 2, the gas inlet 3*b* of the second-stage ejector 3 is connected to the gas outlet 2*a* of the separator 2, an outlet 3*c* of the ejector 3 is connected to the second-stage separator 4, the separators 2 and 4 are interconnected by a pipe 7. The suction side 5*a* of the pump 5 is connected to the first-stage separator 2, the pipe 7 constitutes a vertical U-tube acting as a hydro seal between the separators. The height (H1) of the U-tube 7 above the motive liquid level in the separator 4 is not less than the height of liquid column created in the U-tube 7 by the motive liquid from the second-stage separator 4 under a pressure difference between the separators 4 and 2.

The system can be furnished with a third stage having a third-stage ejector 8 and a third-stage separator 9 and intended for compression of the evacuated gaseous medium. In this case the gas inlet 8*b* of the third-stage ejector 8 is connected to the separator 4, the liquid inlet 8*a* of the ejector 8 is connected to the discharge side 5*b* of the pump 5, an outlet 8*c* of the ejector 8 is connected to the third-stage separator 9. The separator 9 is connected to the first-stage separator 2 through a vertical U-tube 10. The height (H2) of the U-tube 10 above the motive liquid level in the third-stage separator 9 is not less than the height of liquid column created by the motive liquid from the separator 9 under the pressure difference between the separators 9 and 2.

There is another embodiment of the system wherein the separator 4 is equipped with a level gage 11, the suction side 5*a* of the pump 5 is connected to the first-stage separator 2, the separators 2 and 4 are interconnected by a pipe 12 instead of the U-tube 7. The pipe 12 is furnished with a flow regulator 13 connected to the level gage 11.

Such a system can also include the third stage. In this case the gas inlet 8*b* of the third-stage ejector 8 is connected to the second-stage separator 4, the liquid inlet 8*a* of the ejector 8 is connected to the discharge side 5*b* of the pump 5, the outlet 8*c* of the ejector 8 is connected to the third-stage separator 9. The separator 9 is furnished with a level gage 16 and is connected to the first-stage separator 2 through a pipe 14 equipped with a flow regulator 15. The flow regulator 15 is connected to the level gage 16.

The operational process of the pump ejector-separator system is realized as follows.

A motive liquid is delivered from the first-stage separator 2 into nozzles of the ejectors 1, 3, 8 through their liquid inlets 1*a*, 3*a*, 8*a* by the pump 5. The motive liquid flowing out of the nozzles of the ejectors 1, 3, 8, respectively evacuates a gaseous medium from the source 6 of evacuated gaseous medium into the ejector 1, from the separator 2 into the ejector 3 and from the separator 4 into the ejector 8. So, the ejector 1 produces and maintains the required vacuum in the source 6 of the evacuated gaseous medium (a vacuum rectification column for example). At the same time the evacuated gaseous medium undergoes compression during its mixing with the motive liquid in the ejector 1. A liquid-gas mixture from the ejector 1 flows into the separator 2 where compressed gas is separated from the motive liquid. The ejector 3 evacuates the compressed gas from the separator 2. The gas is additionally compressed in the ejector 3. Then a gas-liquid mixture formed in the ejector 3 flows into the second-stage separator 4. In some cases the compression ratio provided by a two-stage system is not enough. In such cases the gaseous medium separated from the motive liquid in the separator 4 is evacuated by the third-stage ejector 8. The gaseous medium undergoes further compression in the ejector 8. Then a gas-liquid mixture formed in the ejector 8 passes into the separator 9 where the additionally compressed gaseous medium is separated from the motive liquid. Finally the additionally compressed gaseous medium from the separator 9 is delivered to consumers (if the evacuated gas is composed of hydrocarbons, most often a boiler-house or a furnace is the consumer of this gas). Portions of the motive liquid accumulated in the separators 4 and 9 pass into the separator 2 by gravity. In the separator 2 the motive liquid is degassed and then is delivered to the suction port 5*a* of the pump 5. In its turn the pump 5 feeds the motive liquid into the nozzles of the ejectors 1, 3, 8 through their liquid inlets 1*a*, 3*a*, 8*a* respectively. Prevention of inrush of the compressed gas from the separators 4 and 9 into the separator 2 during bypassing of the motive liquid is an indispensable condition for proper operation of the system. This condition can be observed in two ways. The first one is when the motive liquid is fed from the separators 4 and 9 into the separator 2 through the U-tubes 7 and 10. The heights of these U-tubes above the levels of motive liquid in the separators 4 and 9 respectively are not less than heights of liquid columns created in the U-tubes 7 and 10 by the motive liquid from the appropriate separators. The U-tubes 7 and 10 perform two functions: firstly they act as hydro seals allowing difference in pressures between the separators and secondly they ensure a minimal required level of the motive liquid in the separators from where the liquid flows. The keeping of the minimal level of the motive liquid is possible because under the pressure difference for example in the separators 4 and 2 the liquid mounts in the U-tube 7 up to a fixed height. The height of the U-tube 7 above the liquid level in the separator 4 is equal to this fixed height of the liquid column in the U-tube. Thus, a rise of the liquid level in the separator 4 results in rising of the liquid column in the U-tube 7. Consequently the motive liquid starts to run over U-bend of the tube 7 and flows from the separator 4 into the separator 2. The motive liquid keeps flowing through the tube 7 for as long as the liquid level in the separator 4 remains above the minimal required level. In its turn, the motive liquid remaining in the separator 4 is a barrier preventing the gaseous medium from penetration from the separator 4 into the separator 2. It is clear that an inlet of the U-tube 7 must be located below the minimal level of the liquid in the separator 4. The U-tube 10 connecting the separators 2 and 9 operates in the same way.

There is another variant of the system, wherein the separators 2 and 4 are interconnected by the pipe 12. The pipe 12 is furnished with the flow regulator 13, the separator 4 is equipped with the level gage 11 and the regulator 13 is connected to the level gage 11. If the level of the motive liquid in the separator is above the minimal required level, the level gage 11 transmits a signal to the flow regulator 13. The flow regulator 13 is opened and a surplus amount of the motive liquid flows from the separator 4 to the separator 2 through the pipe 12. When the liquid level in the separator 4 arrives at the minimal required level, an appropriate signal from the level gage 11 closes the flow regulator 13. Bypassing of the motive liquid from the separator 9 into the separator 2 through the pipe 14 is affected in the same way. The duties of the flow regulator 15 and the level gage 16 correspond to the duties of the regulator 13 and gage 11.

Industrial Applicability

This invention can be applied in chemical, petrochemical, food and some other industries.

What is claimed is:

1. An operating process of a pump-ejector-separator system, comprising delivering a motive liquid into a liquid inlet of a first-stage liquid-gas ejector and a second-stage liquid-gas ejector by a pump;

evacuating a gaseous medium by the first-stage liquid-gas ejector;

compressing the gaseous medium in the first-stage liquid-gas ejector;

discharging a gas-liquid mixture containing the evacuated gaseous medium from the first-stage liquid-gas ejector into a first-stage separator;

separating the gas-liquid mixture in the first-stage separator into a compressed gas and the motive liquid;

evacuating the compressed gas from the first-stage separator by the second-stage liquid-gas ejector;

additionally compressing the evacuated compressed gas in the second-stage liquid-gas ejector;

discharging a second gas-liquid mixture containing the additionally compressed gas from the second-stage liquid-gas ejector into a second-stage separator;

separating the second gas-liquid mixture in the second-stage separator into the additionally compressed gas and the motive liquid;

subsequently delivering the additionally compressed gas from the second-stage separator to consumers;

bypassing the motive liquid from the second-stage separator directly into the first-stage separator; and subsequently delivering the motive liquid from the first-stage separator to the suction port of the pump.

2. The operating process according to claim 1, wherein said step of bypassing the motive liquid from the second-stage separator directly into the first-stage separator includes forcing by a difference between pressures in the second-stage and first-stage separators and adjusting a volume of the bypassed motive liquid by artificially creating hydraulic resistance.

3. The operating process according to claim 1 further including cooling the motive liquid prior to delivering the motive liquid into the suction port of the pump.

4. A multiple-stage pump-ejector-separator system, comprising:

a first-stage ejector;

a first-stage separator;

a second-stage ejector;

a second-stage separator; and a pump; wherein:

a discharge side of the pump is connected to a respective liquid inlet of the first-stage ejector and the second-stage ejector;

a gas inlet of the first-stage ejector is connected to a source of an evacuated gaseous medium;

an outlet of the first-stage ejector is connected to the first-stage separator;

a gas inlet of the second-stage ejector is connected to a gas outlet of the first-stage separator;

an outlet of the second-stage ejector is connected to the second-stage separator;

a suction side of the pump is connected to the first-stage separator; and the first-stage separator and the second-stage separator are directly interconnected by a vertical U-tube acting as a hydro seal, wherein a height of the U-tube above a level of a volume of the motive liquid in the second-stage separator is not less than a height of a liquid column created in the U-tube by the motive liquid from the second-stage separator under a pressure differential between the first-stage separator and the second-stage separator.

5. The system according to claim 4, further comprising a third stage having a third-stage ejector and a third-stage separator, wherein a gas inlet of the third-stage ejector is connected to the second-stage separator, a liquid inlet of the third-stage ejector is connected to the discharge side of the pump, an outlet of the third-stage ejector is connected to the third-stage separator, and the third-stage separator is connected to the first-stage separator through a second vertical U-tube.

6. A multiple-stage pump-ejector-separator system, comprising:

a first-stage ejector;

a first-stage separator, a second-stage ejector;

a second-stage separator; and a pump; wherein:

a discharge side of the pump is connected to a respective liquid inlet of the first-stage ejector and the second-stage ejector;

a gas inlet of the first-stage ejector is connected to a source of an evacuated gaseous medium;

an outlet of the first-stage ejector is connected to the first-stage separator;

a gas inlet of the second-stage ejector is connected to a gas outlet of the first-stage separator;

an outlet of the second-stage ejector is connected to the second-stage separator;

the second-stage separator includes a level gage;

a suction side of the pump is connected to the first-stage separator; and the first-stage separator and the second-stage separator are directly interconnected by a pipe, wherein the pipe includes a regulator of the motive liquid flow connected to the level gage.

7. The system according to claim 6, further comprising a third stage having a third-stage ejector and a third-stage separator, wherein a gas inlet of the third-stage ejector is connected to the second-stage separator, a liquid inlet of the third-stage ejector is connected to the discharge side of the pump, an outlet of the third-stage ejector is connected to the third-stage separator, the third-stage separator is connected to the first-stage separator through a second pipe having a second flow regulator, and wherein the second flow regulator is connected to a second level gage of the third-stage separator.

* * * * *